US008756877B2

(12) United States Patent
LaCrosse

(10) Patent No.: US 8,756,877 B2
(45) Date of Patent: Jun. 24, 2014

(54) GROUND ANCHOR

(76) Inventor: Wills LaCrosse, Duluth, GA (US)

( * ) Notice: Subject to any disclaimer, the term of this patent is extended or adjusted under 35 U.S.C. 154(b) by 2697 days.

(21) Appl. No.: 11/109,652

(22) Filed: Apr. 20, 2005

(65) Prior Publication Data

US 2006/0236620 A1 Oct. 26, 2006

(51) Int. Cl.
*E02D 5/74* (2006.01)
*E02D 5/80* (2006.01)

(52) U.S. Cl.
USPC ..... 52/155; 52/160; 52/704; 405/259.1

(58) Field of Classification Search
USPC ..... 52/223.13, 301, 155, 156, 160, 701, 52/704; 405/259.1, 259.3, 259.4; 256/65.14
See application file for complete search history.

(56) References Cited

U.S. PATENT DOCUMENTS

| | | | | | |
|---|---|---|---|---|---|
| 958,127 | A | * | 5/1910 | Hovrud | 52/160 |
| 1,025,799 | A | * | 5/1912 | Fulenwider | 411/448 |
| 1,108,483 | A | | 8/1914 | Abramson | |
| 1,433,411 | A | | 10/1922 | Plant | |
| 2,351,449 | A | * | 6/1944 | Noble | 405/224 |
| 2,560,643 | A | | 7/1951 | Hallock | |
| 2,580,948 | A | * | 1/1952 | Pancake | 40/607.08 |
| 3,187,858 | A | * | 6/1965 | Des Champs | 52/160 |
| 3,377,807 | A | * | 4/1968 | Nave | 405/259.4 |
| 3,526,069 | A | * | 9/1970 | Deike | 52/160 |
| 3,637,244 | A | * | 1/1972 | Strizki | 52/98 |
| 3,676,965 | A | * | 7/1972 | Deike | 52/98 |
| 3,680,274 | A | * | 8/1972 | Deike | 52/157 |
| 3,855,745 | A | * | 12/1974 | Patterson et al. | 52/159 |
| 4,079,557 | A | | 3/1978 | Watanabe | |
| 4,533,288 | A | | 8/1985 | Rivkin et al. | |
| 4,641,472 | A | | 2/1987 | Young et al. | |
| 4,930,963 | A | | 6/1990 | Rockenfeller et al. | |
| 5,010,698 | A | * | 4/1991 | Hugron | 52/160 |
| 5,509,769 | A | | 4/1996 | Larson et al. | |
| 5,809,700 | A | * | 9/1998 | Roush et al. | 52/4 |
| 6,256,942 | B1 | * | 7/2001 | Schatz | 52/155 |

FOREIGN PATENT DOCUMENTS

FR 2628777 A1 * 9/1989

* cited by examiner

*Primary Examiner* — Adriana Figueroa
(74) *Attorney, Agent, or Firm* — Welsh Flaxman & Gitler LLC

(57) ABSTRACT

A ground anchor system shaped and dimensioned for secure attachment within a support surface. The ground anchor system includes a primary anchor body extending along a longitudinal axis and including a first end and a second end. A coupling member is associated with the first end of the anchor body. A fastening assembling extends from the second end of the anchor body, the fastening assembly being composed of a plurality of downwardly extending facets, wherein each facet includes a first end and a second end. The first end of each facet is secured to the second end of the anchor body and the second end extends away from the anchor body. The second end of each facet includes a tip end having a facing surface cut at an obliquely oriented angle relative to the longitudinal axis of the anchor body such that upon installation into the support surface the second end of each of the plurality of facets is forced outwardly from the longitudinal axis as a result of the outward force generated by the interaction of the tip end with the support surface.

9 Claims, 6 Drawing Sheets

FIG.1
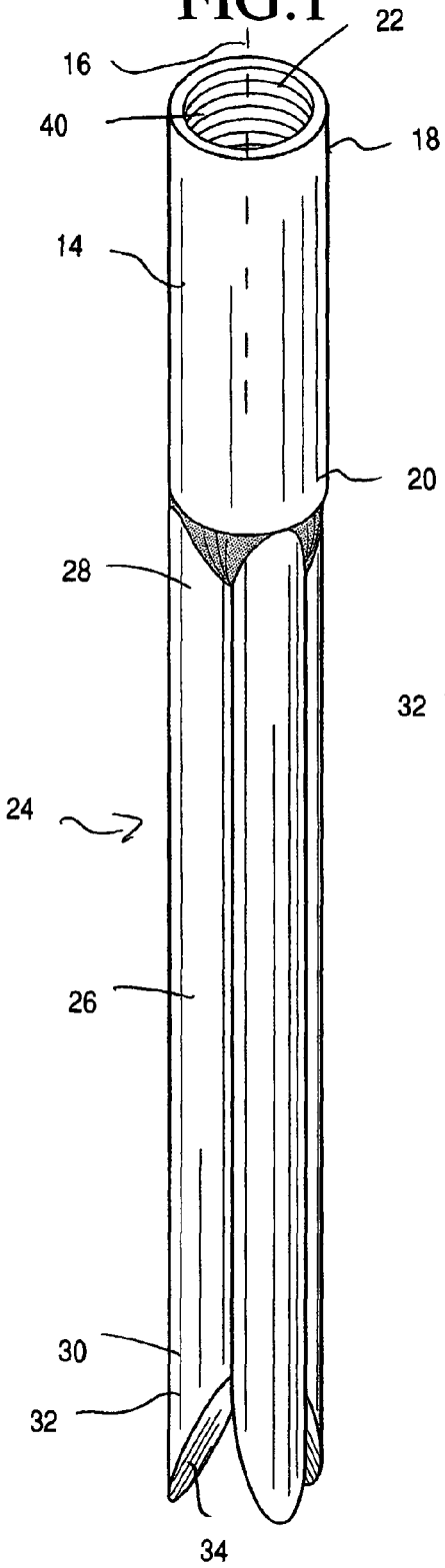
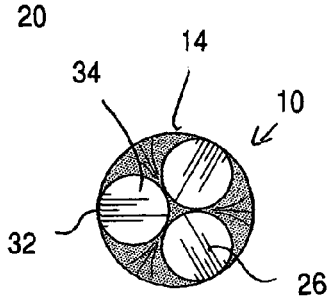
FIG.3
FIG.2
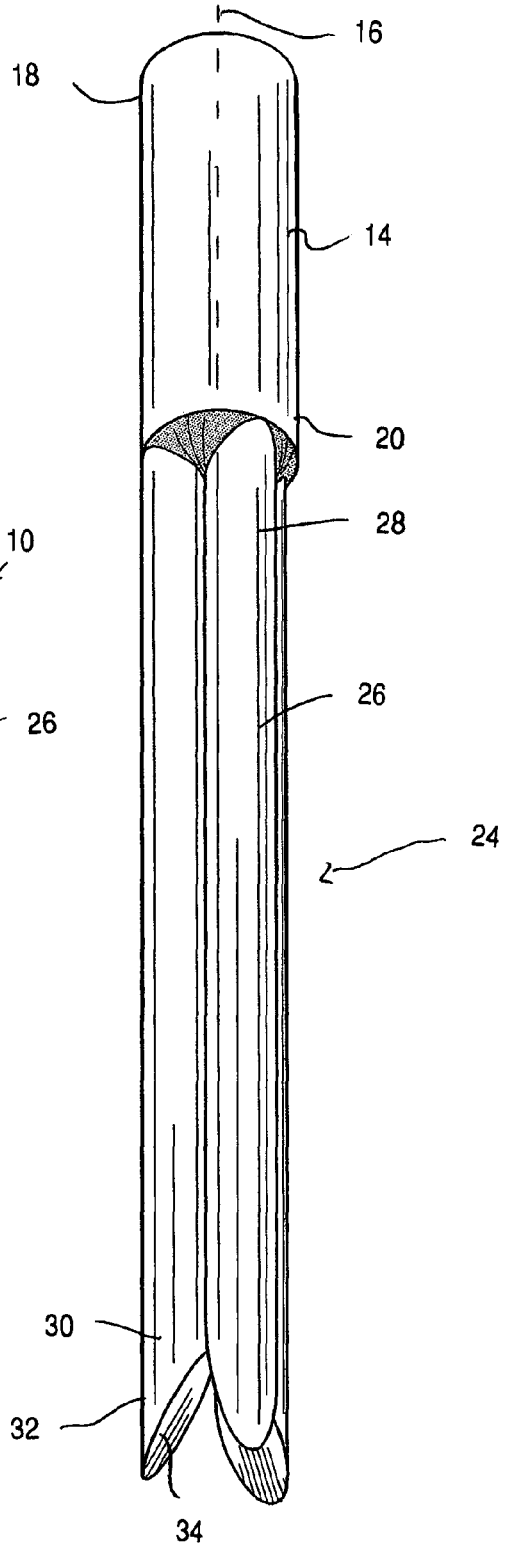

GROUND ANCHOR

BACKGROUND OF THE INVENTION

1. Field of the Invention

The invention relates to a ground anchor. More particularly, the invention relates to a ground anchor including a split stake that deforms when driven into the ground causing improved friction and increased holding power in vertical and off-angle directions. The invention further relates to the use of a tensioning sleeve in conjunction with the split stake to enhance the stability and usefulness of the present ground anchor.

2. Description of the Prior Art

Ground anchoring devices exist to provide a secure connection for a variety of devices requiring anchoring. Anchoring devices generally screw, twist or extend straight into the ground. The friction created between the ground and the anchor provides the holding power for each device. Pullout strengths vary between devices. Screw in type devices generally have higher pullout strengths due to the extra "bite" of friction created by the semi-horizontal screws/fins.

However, existing ground anchors are ineffective when used in asphalt. Only straight, penetrating nail type anchors are generally useful in asphalt applications. However, straight male anchors are relatively ineffective in preventing vertical pullout, but are able to sustain off-angle strength at the expense of damage to surrounding asphalt surfaces as loads are applied and/or varied.

In addition, current anchors provide no provision for flush mounting. As such, they must be removed after each use to avoid creating upstanding obstacles. Still further, since these anchors must be removed after each use, they don't allow for repeated use. Additionally, once the anchors are used and removed they create holes and weaken the asphalt in the area in which the anchor punctured the asphalt. This may be undesirable in some circumstances when precise repeated placement is required, for example, when a booth at a flea market needs to be installed weekly. In addition, current asphalt anchors break the surface seal and allow water and other elements infiltrate the previously sealed surface.

As a result, a need currently exists for an asphalt anchor providing substantial vertical pullout resistance and off-angle strength. In addition, an asphalt anchor is required which provides for flush mounting and repeated use. Still further, an asphalt anchor which seals the surface when installed is also needed. The present invention provides such an asphalt anchor.

SUMMARY OF THE INVENTION

It is, therefore, an object of the present invention to provide a ground anchor system shaped and dimensioned for secure attachment within a support surface. The ground anchor system includes an anchor having a primary anchor body extending along a longitudinal axis and including a first end and a second end. A coupling member is associated with the first end of the anchor body. A fastening assembling depends from the second end of the anchor body, the fastening assembly being composed of a plurality of downwardly extending facets, wherein each facet includes a first end and a second end. The first end of each facet is secured to the second end of the anchor body and the second end extends away from the anchor body. The second end of each facet includes a tip end having a facing surface cut at an obliquely oriented angle relative to the longitudinal axis of the anchor body such that upon installation into the support surface the second end of each of the plurality of facets is forced outwardly from the longitudinal axis as a result of the outward force generated by the interaction of the tip end with the support surface.

It is also an object of the present invention to provide a ground anchor system wherein each of the plurality of facets is welded to the anchor body.

It is another object of the present invention to provide a ground anchor system including a tension sleeve shaped and dimensioned for selective coupling to the anchor body for pretensioning the anchor body and fastening assembly.

It is a further object of the present invention to provide a ground anchor system wherein the anchor body includes external threading shaped and dimensioned for engaging threading formed along the tension sleeve.

It is also an object of the present invention to provide a ground anchor system wherein the coupling member is a recess formed in the first end of the anchor body.

It is also another object of the present invention to provide a ground anchor system wherein the recess is threaded for attachment to a similarly threaded object requiring anchoring.

It is still a further object of the present invention to provide a ground anchor system wherein the fastening assembly includes three facets.

It is also an object of the present invention to provide a ground anchor system wherein each of the plurality of facets includes a facing surface that is angled toward facing surfaces of the other facets such that upon insertion of the anchor within the support surface the interaction between the facing surfaces of the respective facets and the support surface will force the second ends of the various facets away from each other and away from the longitudinal axis of the anchor body.

It is another object of the present invention to provide a ground anchor system including a tension sleeve shaped and dimensioned for selective coupling to the anchor body for pretensioning the anchor, wherein the tension sleeve includes a thrust lip limiting penetrating depth of the tension sleeve.

It is a further object of the present invention to provide an ground anchor system including a tension sleeve shaped and dimensioned for selective coupling to the anchor body for pretensioning the anchor, wherein the tension sleeve includes a square edge shape aligned with the primary body of the tension sleeve.

It is yet another object of the present invention to provide a ground anchor system wherein the anchor body and the anchor facets occupy approximately the same diametric profile.

Other objects and advantages of the present invention will become apparent from the following detailed description when viewed in conjunction with the accompanying drawings, which set forth certain embodiments of the invention.

BRIEF DESCRIPTION OF THE DRAWINGS

FIGS. 1 and 2 are perspective views of a first embodiment of the present ground anchor.

FIG. 3 is bottom view of the first embodiment of the present ground anchor.

FIGS. 13*a* and 13*b* are side views of alternate embodiments of the invention disclosed with reference to FIG. 7, wherein FIG. 13*a* shows the use of pin holes for actuation thereof and FIG. 13*b* shows a tension sleeve with a square edge.

DESCRIPTION OF THE PREFERRED EMBODIMENTS

Figure 4:
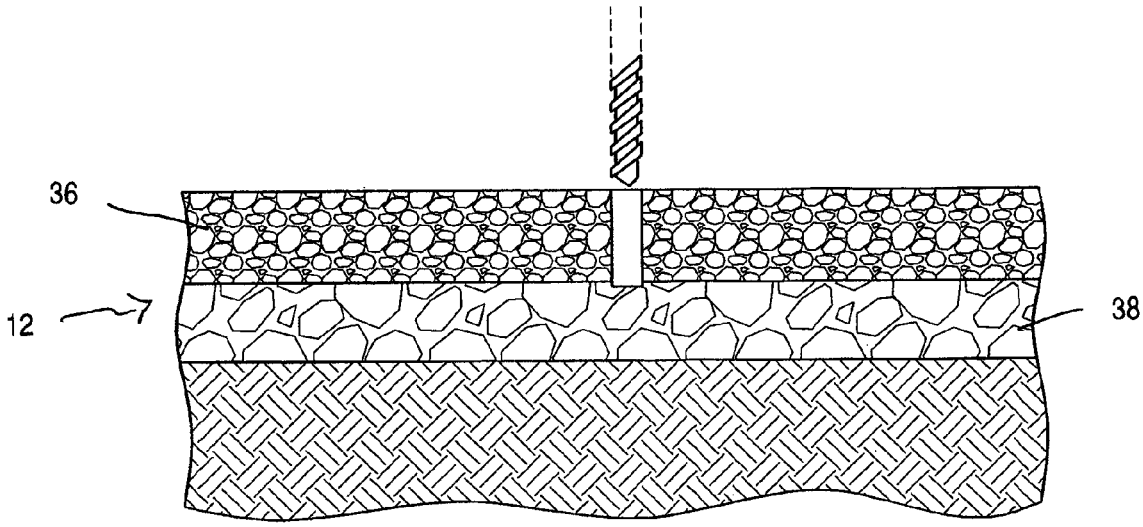
FIGS. 4, 5 and 6 are a series of views showing installation of the present ground anchor.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1, 2, 3, 4, 5 and 6, a ground anchor 10 shaped and dimensioned for secure attachment within a support surface 12 is disclosed. The ground anchor 10 is particularly adapted to anchoring within an asphalt support surface 12, although those skilled in the art will certainly appreciate other applications might be achieved without departing from the spirit of the present invention. It is contemplated the ground anchor 10 will be particularly useful in supporting signs, tents, booths, industrial equipment, buildings and airplane hold down bolts, although those skilled in the art certainly appreciate a wide variety of uses.

The ground anchor 10 generally includes a primary anchor body 14 extending along a longitudinal axis 16. The anchor body 14 includes a first end 18 and a second end 20. A coupling member 22 is associated with the first end 18 of the anchor body 14. The coupling member 22 is shaped and dimensioned for a variety of objects that one might wish to securely attach to the present ground anchor. A fastening assembling 24 extends from the second end 20 of the anchor body 14. The fastening assembly 24 is composed of a plurality of downwardly extending facets 26, wherein each facet 26 includes a first end 28 and a second end 30. The first end 28 of each facet 26 is secured to the second end 20 of the anchor body 14 and the second end 30 extends away from the anchor body 14. The second end 30 of each facet 26 includes a tip end 32 having a facing surface 34 cut at an oblique angle relative to the longitudinal axis 16 of the anchor body 14 such that upon installation into the support surface 12 the second end 30 of each of the plurality of facets 26 is forced outwardly from the longitudinal axis 16 as a result of the outward force generated by the interaction of the facing surface 34 with the support surface 12.

The primary anchor body 14 is constructed from steel, stainless steel, aluminum and/or other metal alloys. In accordance with a preferred embodiment of the present invention, the anchor body 14 is cylindrical and is approximately 1 to 12 inches long depending upon the particular application. Ultimately, the length of the anchor body 14 is determined by the thickness of the top asphalt layer 36 through which the ground anchor 10 is intended to pass through. The anchor body 14 should be slightly longer than the thickness of the top asphalt layer 36 such that the asphalt may be predrilled for insertion of the ground anchor 10 without permitting facet 26 to spread until the facets 26 penetrate the rock base 38. The overall length of a ground anchor generally ranges from 4-36 inches.

In accordance with a preferred embodiment of the present invention, the coupling member 22 includes a threaded recess 40 formed in the first end 18 of the anchor body 14. The recess 40 is threaded for the insertion of a properly sized eyebolt, or other threaded fastener, to which an object requiring anchoring may be tethered. In accordance with a preferred embodiment of the present invention, the coupling member is sized to accept approximately a ⅜-inch to 1-inch anchor screw, although the coupling member may certainly be sized to accept a wide range of anchor screws depending upon the desired application. As those skilled in the art will certainly appreciate, the threaded recess 40 disclosed in accordance with a preferred embodiment of the present invention is only one of many known coupling structures and other coupling structures may be employed without departing from the spirit of the present invention.

With regard to the extending facets, a plurality of extending facets 26 is coupled to the second end 20 of the anchor body 14. In accordance with a disclosed embodiment, three facets 26 are disclosed, although those skilled in the art will understand that the number of facets may be varied without departing from the spirit of the present invention. Further, and in accordance with a preferred embodiment of the present invention, each of the facets 26 ate formed from the same materials as the anchor body, although other materials may be employed without departing from the spirit of the present invention. It is further contemplated that the facets 26 are secured to the second end of the anchor body 14 via welding, although other coupling techniques may be employed without departing from the spirit of the present invention. Still further, the facets and anchor body may be formed of one integral piece; that is, the facets would be preferably formed by cutting into a solid metal stock from which both the anchor body and the facets are formed.

Each facet 26 includes a first end 28 and a second end 30. As mentioned above, the first end 28 of each facet 26 is secured to the second end 20 of the anchor body 14 and the second end 30 of each facet 26 extends away from the anchor body 14. The second end 30 of each facet 26 includes a tip end 32 having a facing surface 34 cut. More particularly, the tip end 32 is cut such that the facing surface 34 is angled toward the cut facing surfaces 34 of the other facets 26. In this way, and upon insertion of the ground anchor 10 within the rock base 38, the interaction between the facing surface 34 and the rock base 38 will force the second ends 30 of the various facets 26 away from each other and away from the longitudinal axis 16 of the anchor body 14. As those skilled in the art will certainly appreciate, the tip end 32, and particularly the facing surface 34, may be adjusted to produce a variety of movements depending upon the specific needs of the application for which the present ground anchor is to be employed.

Figure 5:
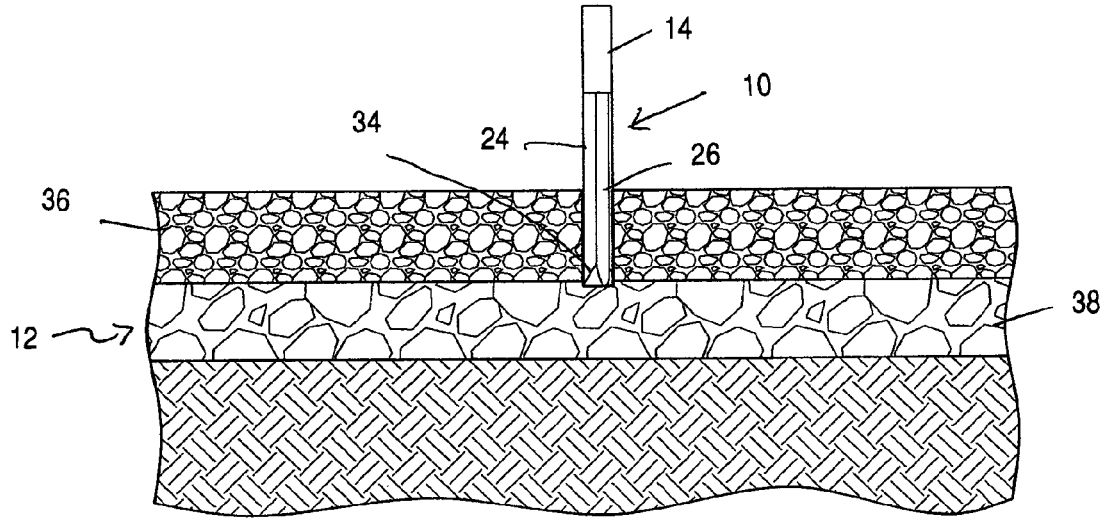
Figure 6:
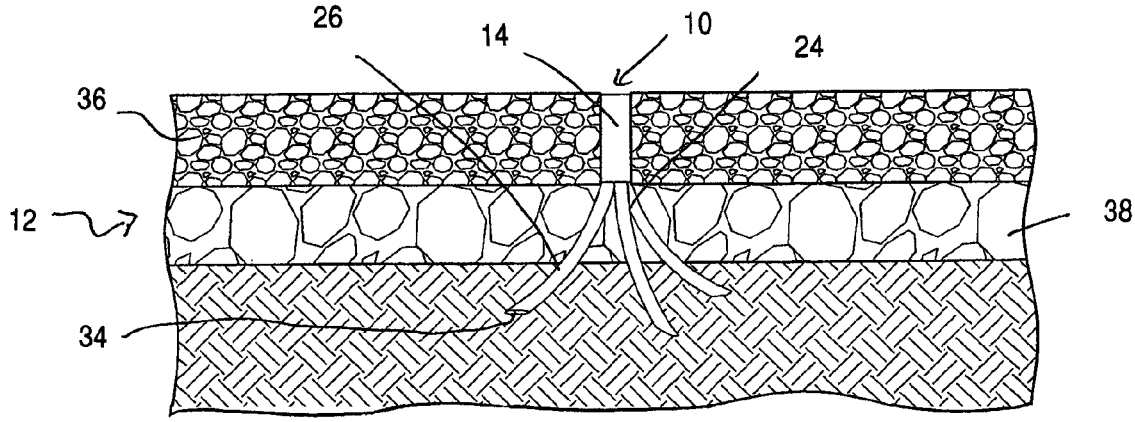
Figure 7:
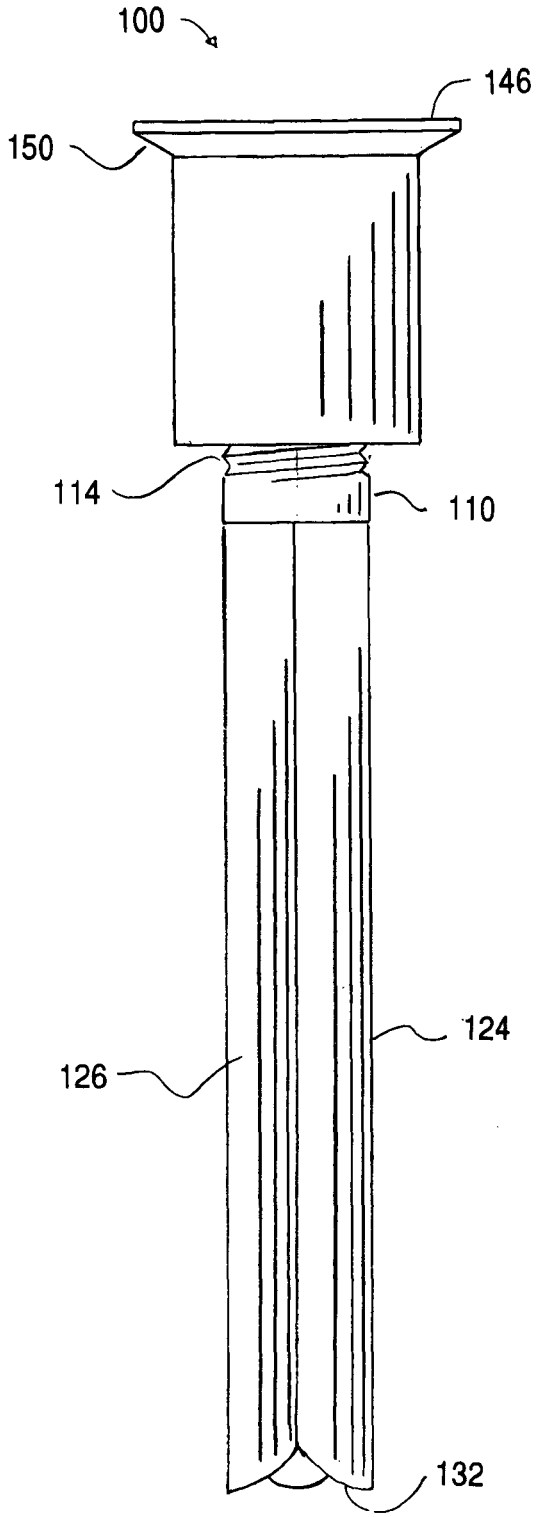
FIG. 7 is a front view of an alternate embodiment of the present ground anchor system in which a tension sleeve is employed to enhance functionality.
Figure 8:
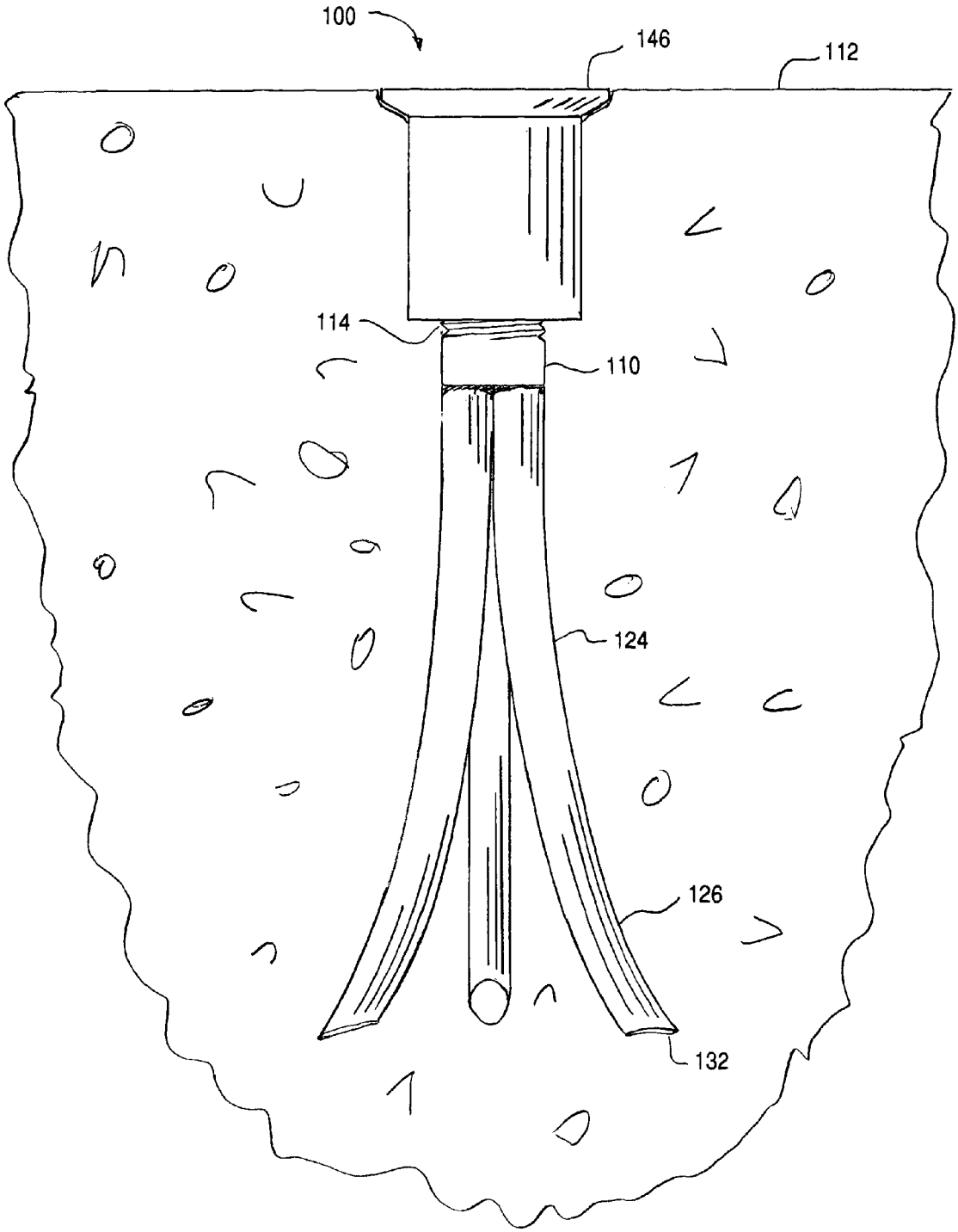
FIG. 8 is a side view of the embodiment disclosed in FIG. 7 with the ground anchor system shown in its deployed configuration.
Figure 9:
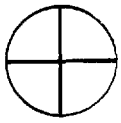
FIGS. 9-11 show various facet configurations contemplated in accordance with present invention.
Figure 10:
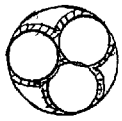
Figure 11:
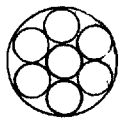

In practice, and with reference to FIGS. 4, 5 and 6, the present ground anchor 10 is installed in the following manner. First, the top asphalt layer 36 is predrilled. The asphalt layer 36 is predrilled to a diameter sufficient to accommodate the insertion of the anchor facets 26 without causing spreading of the facets 26. In accordance with a preferred embodiment, the anchor body 14 will be approximately the same length as the top asphalt layer 34, therefore, optimizing the surface area of the facets 26 that spread within the underlying rock base 38.

In fact, insertion of the ground anchor 10 and the reliability of the ground anchor 10 are enhanced by forming the anchor body 14 and the anchor facets 26 such that they occupy approximately the same diametric profile. In this way, there is very little play between the exterior walls of the facets/anchor body and the interior wall of the predrilled hole. This ultimately adds to the stability of the present ground anchor. In accordance with a preferred embodiment of the present invention, the ground anchor will have an outer diameter of approximately 1 to 3 inches, although those skilled in the art will appreciate that various diameters may be used without departing from the spirit of the present invention.

Once the asphalt layer 36 is predrilled, the facets 26 of the ground anchor 10 are inserted within the predrilled hole and the ground anchor 10 is forced downwardly to set the ground anchor 10 in a desired position. As the ground anchor 10 is forced downwardly, the facing surfaces 34 at the second ends 30 of the respective plurality of facets 26 contact the rock base 38 causing the second ends 30 of the facets 26 to be forced away from each other and away from the longitudinal axis 16 of the anchor body 14. The outward movement helps to secure the ground anchor 10 within the rock base 38 in a manner opposing both upward and lateral movement. Once the ground anchor 10 is installed, an object may be secured thereto through the use of the coupling member.

After setting the ground anchor 10 flush to the asphalt support surface 12, the spread facets 26 provide improved friction in different planes for anchor strength in the vertical direction and in off-angle directions. The ground anchor 10 remains permanently embedded. The ground anchor 10 may then be sealed around its circumference to prevent water from entering between the asphalt and anchor body 14. This prevents degradation of the asphalt from effects of water and other elements of concern. Flush mounting in accordance with the present invention allows repaving without requiring removal of the ground anchor and resurfacing only requires setting of the ground anchor deeper so that it is below the surface being resurfaced.

A further embodiment of an anchor system 100 is disclosed with reference to FIGS. 7 through 17. This embodiment employs the use of a tension sleeve 146 in conjunction with the anchor 110 generally described above. Briefly, and as will be discussed below in greater detail, the tension sleeve 146 is secured about the anchor body 114 for movement relative thereto so as to create tension along the fastening assembly 124 prior to coupling of a structural member requiring anchoring. As the tension sleeve 146 is moved relative to the anchor body 114, the fastening assembly 124 is tensioned relative to the ground in which it is installed, creating a pretension before coupling of the anchored structural member thereto.

As with the prior embodiment, the anchor 110 is shaped and dimensioned for secure attachment within a support surface 112. The anchor 110 generally includes a primary anchor body 114 extending along a longitudinal axis 116. The anchor body 114 includes a first end 118 and a second end 120 and a fastening assembly 124 composed of a plurality of facets 126 substantially the same as described above. As with the prior embodiment, the anchor 110 has three facets 126 that ate designed to spread out as the anchor 110 is driven into the ground 112. The spreading of the facets 126 is aided by the angle of cut at the tip end 132 of each facet 126. Although three facets are disclosed in accordance with a preferred embodiment of the present invention, the number may vary depending on the soil encountered and the grip required (for example, see FIGS. 9-11).

However, the anchor body 114 includes external threading 142 shaped and dimensioned for receiving internal threading 144 of the tension sleeve 146. In this way, the tension sleeve 146 may be secured about the anchor body 114 for pretensioning of the anchor 110. Rotation of the tension sleeve 146 is facilitated by the inclusion of pin holes 148*a* (see FIG. 13*a*) or slots 148 (see FIGS. 13 and 17) shaped and dimensioned for the receipt of a spanner wrench or other tool.

Generally, the anchor 110 is installed in much the same manner as discussed above with regard to the embodiment disclosed with reference to FIGS. 1 to 6. In accordance with a preferred embodiment, the anchor 110 is driven into the ground 112 by a mallet or by mechanical means (typically by hydraulic or an impact hammer), and the tension sleeve 146 is then screwed down onto the anchor 110 until it is flush with the ground 112. The rotative force is applied by applying torque on the slot 148 provided along the top surface of the tension sleeve 146. It is contemplated in accordance with an alternate embodiment that torque may be applied to the tension sleeve 146 via a spanner wrench designed to mate with matching pin holes 148*a* drilled in the tension sleeve 146.

Depending on the application, the tension sleeve 146 may or may not be furnished with a thrust lip 150 that limits the penetrating depth of the tension sleeve 146 as it is applied over the anchor 110. In addition, certain applications may only require a square edge shape 152 aligned with the primary body of the tension sleeve 146 (see FIG. 13*b*).

Figure 15:
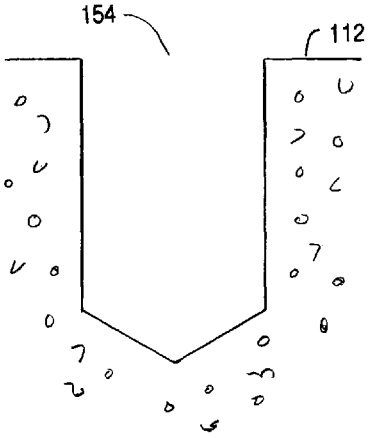
FIGS. 15, 16 and 17 show the various steps in deployment of the ground anchor system disclosed with reference to FIG. 7.
Figure 16:
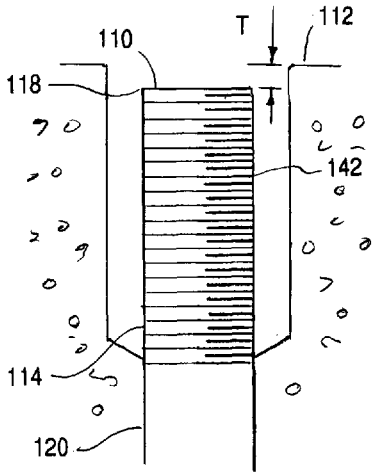
Figure 17:
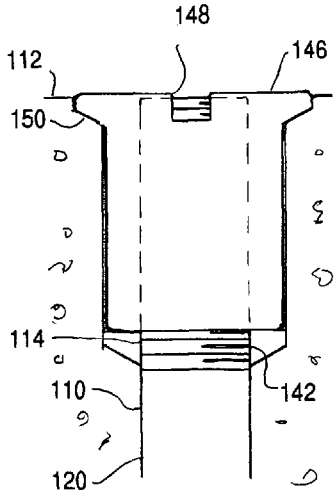
Figure 12:
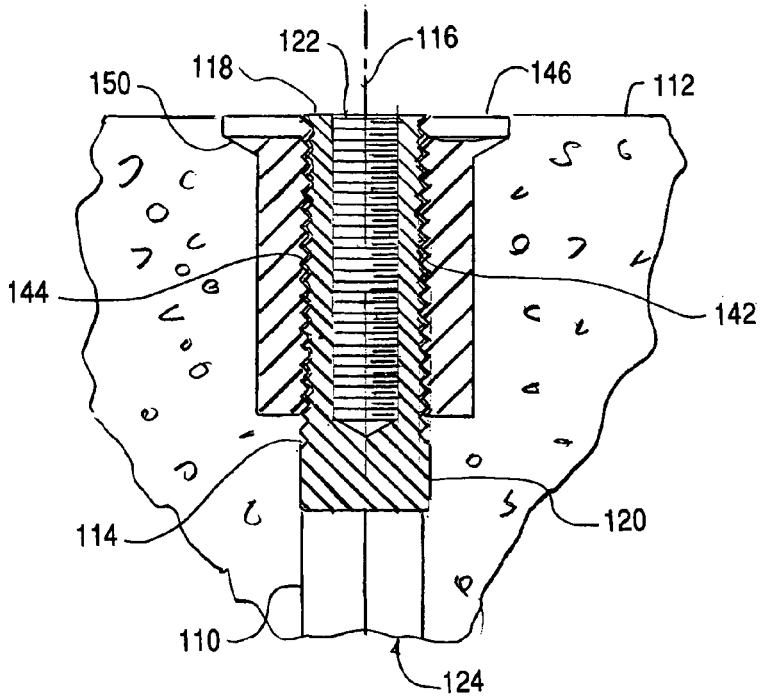
FIG. 12 is a cross sectional view of the embodiment disclosed in FIG. 7.
Figure 13:
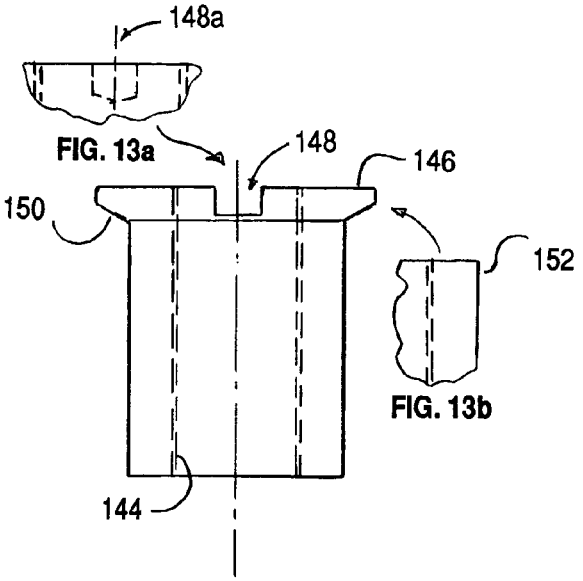
FIG. 13 is a side view of the tension sleeve.
Figure 14:
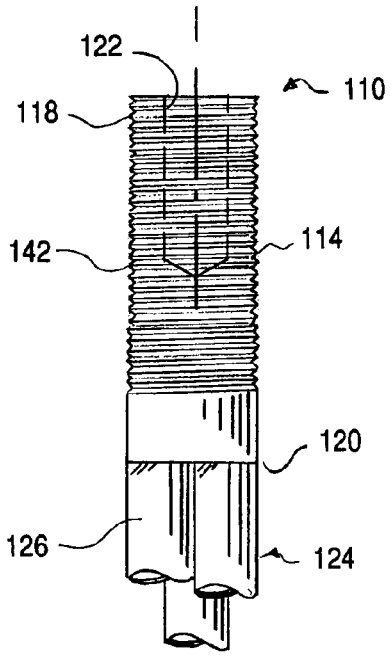
FIG. 14 is a side view of the anchor.

Referring to FIGS. 15 to 17, the installation process is disclosed in detail. For most applications a hole 154 is predrilled in the ground material 112 to an appropriate depth as shown in FIG. 15. The anchor 110 is driven into the ground 112 at the center of the predrilled hole 154 by manual or mechanical means as discussed above. Depending on the tension required by the application, the anchor 110 is driven to a depth "T" below the ground surface as shown in FIG. 16.

Once the anchor 110 is properly positioned within the ground 112, the tension sleeve 146 is screwed on the anchor body 114 by engaging the screwdriver slot 148 or pin holes 148*a* found on the top of the tension sleeve 146 by manual or mechanical means. The tension sleeve 146 is tightened until it is flush with the ground surface or until the appropriate amount of pre-tension is achieved in the anchor 110. The benefits of pre-tensioning the anchor 110 through the use of the present tension sleeve 146 are similar to those benefits achieved with standard bolted connections. The pre-tensioned joint compresses the ground area while putting a tensile load on the anchor. Connections to the anchor 110 have a maximum allowable load less than the pre-tensioned load to assure joint integrity. The effects of slippage, joint separation, ground fatigue failure, and loose connections are all minimized with pre-tensioning. As such, use of the present tension sleeve provides higher safety and strength holding values. The prior embodiment, that is, without the tension sleeve, may be employed in lower strength applications.

Once the present anchoring system is installed, connection can be made to the anchor by accessing the smaller drilled and tapped hole 122 in the center of the anchor 110. An eye bolt or standard bolt can be used. After use, the bolt can be unscrewed and a temporary covering placed over or threaded into the hole if desired to allow ease of use in the future. Flush mounting on asphalt surfaces allows normal maintenance of the surface without having to take any special operating precautions.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A ground anchor system shaped and dimensioned for secure attachment within a support surface, comprising:

an anchor including:

an anchor body extending along a longitudinal axis and including a first end and a second end;

a coupling member associated with the first end of the anchor body, wherein the coupling member is a recess formed in the first end of the anchor body, and the recess is threaded for attachment to a similarly threaded object requiring anchoring; and a fastening assembly depending from the second end of the anchor body, the fastening assembly being composed of at least three downwardly extending facets, wherein each facet includes a first end and a second end, the first end of each facet being secured to the second end of the anchor body and the second end extending away from the anchor body;

the second end of each facet includes a tip end having a facing surface cut at an obliquely oriented angle relative to the longitudinal axis of the anchor body such that upon installation into the support surface the second end of each of the plurality of facets is forced outwardly from the longitudinal axis as a result of the outward force generated by the interaction of the tip end with the support surface; and wherein the anchor body and the anchor facets occupy approximately the same diametric profile.

2. The ground anchor system according to claim 1, wherein each of the plurality of facets are welded to the anchor body.

3. The ground anchor system according to claim 1, further including a tension sleeve shaped and dimensioned for selective coupling to the anchor body for pretensioning the anchor.

4. The ground anchor system according to claim 3, wherein the anchor body includes external threading shaped and dimensioned for engaging threading formed along the tension sleeve.

5. The ground anchor system according to claim 1, wherein the fastening assembly includes three facets.

6. The ground anchor system according to claim 5, wherein each of the plurality of facets includes a facing surface that is angled toward facing surfaces of the other facets such that upon insertion of the anchor within the support surface the interaction between the facing surfaces of the respective facets and the support surface will force the second ends of the various facets away from each other and away from the longitudinal axis of the anchor body.

7. The ground anchor system according to claim 1, further including a tension sleeve shaped and dimensioned for selective coupling to the anchor body for pretensioning the anchor, wherein the tension sleeve includes a first end and a second end, the first end being adapted for positioning flush with a ground surface, the tension sleeve includes a outwardly extending thrust lip adjacent the first end of the tension sleeve limiting the penetrating depth of the tension sleeve.

8. The ground anchor system according to claim 1, further including a tension sleeve shaped and dimensioned for selective coupling to the anchor body for pretensioning the anchor, wherein the tension sleeve includes a square edge shape aligned with the primary body of the tension sleeve.

9. A ground anchor system shaped and dimensioned for secure attachment within a support surface, comprising:

an anchor including:

an anchor body having a diametric profile extending along a longitudinal axis and including a first end and a second end, wherein the anchor body includes an exterior surface which includes threading;

a coupling member associated with the first end of the anchor body, wherein the coupling member is a recess formed in the first end of the anchor body, and the recess is threaded for attachment to a similarly threaded object requiring anchoring; and a fastening assembly depending from the second end of the anchor body, the fastening assembly being composed of at least three downwardly extending facets, wherein each facet includes a first end and a second end, the first end of each facet being secured to the second end of the anchor body and the second end extending away from the anchor body;

the second end of each facet includes a tip end having a facing surface cut at an obliquely oriented angle relative to the longitudinal axis of the anchor body such that upon installation into the support surface the second end of each of the plurality of facets is forced outwardly from the longitudinal axis as a result of the outward force generated by the interaction of the tip end with the support surface.

* * * * *